US010589924B2

(12) United States Patent
Richardson

(10) Patent No.: US 10,589,924 B2
(45) Date of Patent: Mar. 17, 2020

(54) CARGO BIN

(71) Applicant: Revolutionary Truck Systems, Orange, CA (US)

(72) Inventor: Robert Richardson, Orange, CA (US)

(73) Assignee: Revolutionary Truck Systems, Orange, CA (US)

( * ) Notice: Subject to any disclaimer, the term of this patent is extended or adjusted under 35 U.S.C. 154(b) by 0 days.

(21) Appl. No.: 15/793,779

(22) Filed: Oct. 25, 2017

(65) Prior Publication Data

US 2018/0111751 A1 Apr. 26, 2018

Related U.S. Application Data

(60) Provisional application No. 62/413,335, filed on Oct. 26, 2016.

(51) Int. Cl.

| | |
|---|---|
| ***B65D 6/18*** | (2006.01) |
| ***B65D 88/52*** | (2006.01) |
| ***B65D 88/16*** | (2006.01) |
| ***B65D 88/12*** | (2006.01) |
| *B65D 6/08* | (2006.01) |

(52) U.S. Cl.

CPC ..... *B65D 88/52* (2013.01); *B65D 88/125* (2013.01); *B65D 88/126* (2013.01); *B65D 88/16* (2013.01); *B65D 88/522* (2013.01)

(58) Field of Classification Search

CPC ..... B65D 2519/00059; B65D 2519/00233; B65D 2519/00532; B65D 2519/00164; B65D 2519/00024; B65D 2519/0097; B65D 2519/00293; B65D 19/12; B65D 9/14; B65D 7/24; B65D 88/52; B65D 90/0026; B65D 19/06; B65D 88/022

USPC ... 220/683, 682, 677, 691, 692, 693, 600, 6, 220/9.2; 206/600

See application file for complete search history.

(56) References Cited

U.S. PATENT DOCUMENTS 2,373,481 A 4/1945 Lease
2,965,259 A 12/1960 Johnson
(Continued)

FOREIGN PATENT DOCUMENTS

DE 4218408 A1 12/1992
WO WO2007/143908 * 12/2007 ..... B65D 19/06

OTHER PUBLICATIONS

Translation of WO 2007/143908 [Guo et al.], Dec. 21, 2007, Brief Description of Drawings.*

*Primary Examiner* — J. Gregory Pickett
*Assistant Examiner* — Niki M Eloshway
(74) *Attorney, Agent, or Firm* — Knobbe Martens Olson & Bear LLP

(57) ABSTRACT

A cargo bin is disclosed. The cargo bin can include a base having an upper surface, and a first side pivotally attached to a first edge of the base. The first side can include a rigid frame and a spanning material. The cargo bin can include a second side pivotally attached to a second edge of the base. The second side can include a rigid frame and a spanning material. The cargo bin can include a front side. The front side can include a spanning material attached on a first end to the rigid framing of the first side. The front side can also include a support attached to a second end of the spanning material, the second end opposite the first end, a first tip of the support configured to be insertable into a first hole in the base to close the front side. The cargo bin can include a back side.

19 Claims, 8 Drawing Sheets

(56) References Cited

U.S. PATENT DOCUMENTS 3,000,602 A 9/1961 O'brien
4,186,841 A * 2/1980 Buckley ..... B65D 19/12 206/511
4,235,346 A 11/1980 Liggett
4,309,013 A * 1/1982 Howe ..... B65D 19/12 108/53.1
4,638,744 A * 1/1987 Clive-Smith ..... B65D 88/129 108/53.1
4,662,532 A * 5/1987 Anderson ..... B65D 19/12 220/1.5
5,289,933 A 3/1994 Streich et al.
5,381,915 A * 1/1995 Yardley ..... B65D 19/16 206/600
5,660,291 A * 8/1997 Dash ..... B65D 7/26 220/6
5,720,405 A 2/1998 Karpisek
5,755,472 A 5/1998 Clive-Smith
5,941,405 A 8/1999 Scales et al.
6,076,690 A * 6/2000 Hemmerly ..... B65D 88/005 220/1.5
6,234,315 B1 5/2001 Karpisek
6,401,953 B2 6/2002 Kofod
6,415,938 B1 7/2002 Karpisek
7,491,024 B2 2/2009 Heinrichs et al.
7,726,496 B2 6/2010 Heinrichs et al.
7,739,965 B2 6/2010 Heinrichs et al.
7,793,599 B2 9/2010 Truksa
8,083,448 B2 12/2011 Heinrichs et al.
9,221,599 B2 * 12/2015 Brennan, Jr. ..... B65D 90/08
2009/0057191 A1 * 3/2009 Temple, Jr. ..... B65D 19/12 206/600
2012/0152946 A1 * 6/2012 Gronholm ..... B65D 19/10 220/6
2015/0239604 A1 8/2015 Arnaud et al.

* cited by examiner

CARGO BIN

INCORPORATION BY REFERENCE TO ANY PRIORITY APPLICATIONS

This application claims priority to U.S. Provisional Application No. 62/413,335, filed Oct. 26, 2016, and incorporated herein by reference. Any and all applications for which a foreign or domestic priority claim is identified in the Application Data Sheet as filed with the present application are hereby incorporated by reference under 37 CFR 1.57.

BACKGROUND

Field

This disclosure relates to cargo bins, and specifically to cargo bins that are securable and/or collapsible.

Description of the Related Art

Items to be transported (referred to herein as cargo) can be grouped together to facilitate loading and unloading. For example, cargo at an origin location can be grouped according to destination and loaded onto pallets, such as, wooden GMA pallets, or into other common shipping containers. The loaded pallets or shipping containers can then be loaded onto a transport vehicle, such as, a truck, train, airplane, etc., for transport to a delivery destination. During transport, the loaded pallets or shipping transports can be transferred between several transport vehicles in route to the delivery destination. At each step in the transport process, cargo on the pallets or shipping containers is subject to tampering or loss. Additionally, after delivery and unloading, traditional shipping containers are often transported back to the origin location in an unloaded state, resulting in an inefficient use of transport space.

SUMMARY

A cargo bin is disclosed. The cargo bin can include a base having an upper surface. The cargo bin can include a first side pivotally attached to a first edge of the base. The first side can include a rigid frame and a spanning material. The cargo bin can include a second side pivotally attached to a second edge of the base. The second edge can be opposite the first edge. The second side can include a rigid frame and a spanning material. The cargo bin can include a front side. The front side can include a spanning material attached on a first end to the rigid framing of the first side. The front side can also include a support attached to a second end of the spanning material, the second end opposite the first end, a first tip of the support configured to be insertable into a first hole in the base to close the front side. The cargo bin can include a back side. These and other features of the cargo bin will become apparent from the following figures and detailed description.

BRIEF DESCRIPTION OF THE DRAWINGS

These drawings depict only several embodiments in accordance with the disclosure and are not to be considered limiting of its scope. In the drawings, similar reference numbers or symbols typically identify similar components, unless context dictates otherwise. The drawings may not be to scale.

DETAILED DESCRIPTION

Disclosed herein are cargo bins. As will be described below in detail, in some embodiments, the cargo bins form securable enclosures that can reduce or prevent tampering, loss, or theft of cargo secured therein. In some embodiments, the cargo bins are configured to be collapsible and stackable for efficient storage and/or backhaul. In some embodiments, the cargo bins are advantageously used in cross-docking applications. The features and advantages of the cargo bins described herein will become more fully apparent from the following description and appended claims, taken in conjunction with the accompanying drawings. Although the drawings illustrate several specific embodiments of cargo bins, these embodiments are provided by way of example only and are not intended to be limiting. The features of any of the embodiments illustrated in drawings or described in text throughout this application can be modified, duplicated, removed, and/or combined with features of any other embodiment illustrated or described herein, or as will be apparent to a person of ordinary skill in the art upon consideration of this disclosure.

Figure 1:
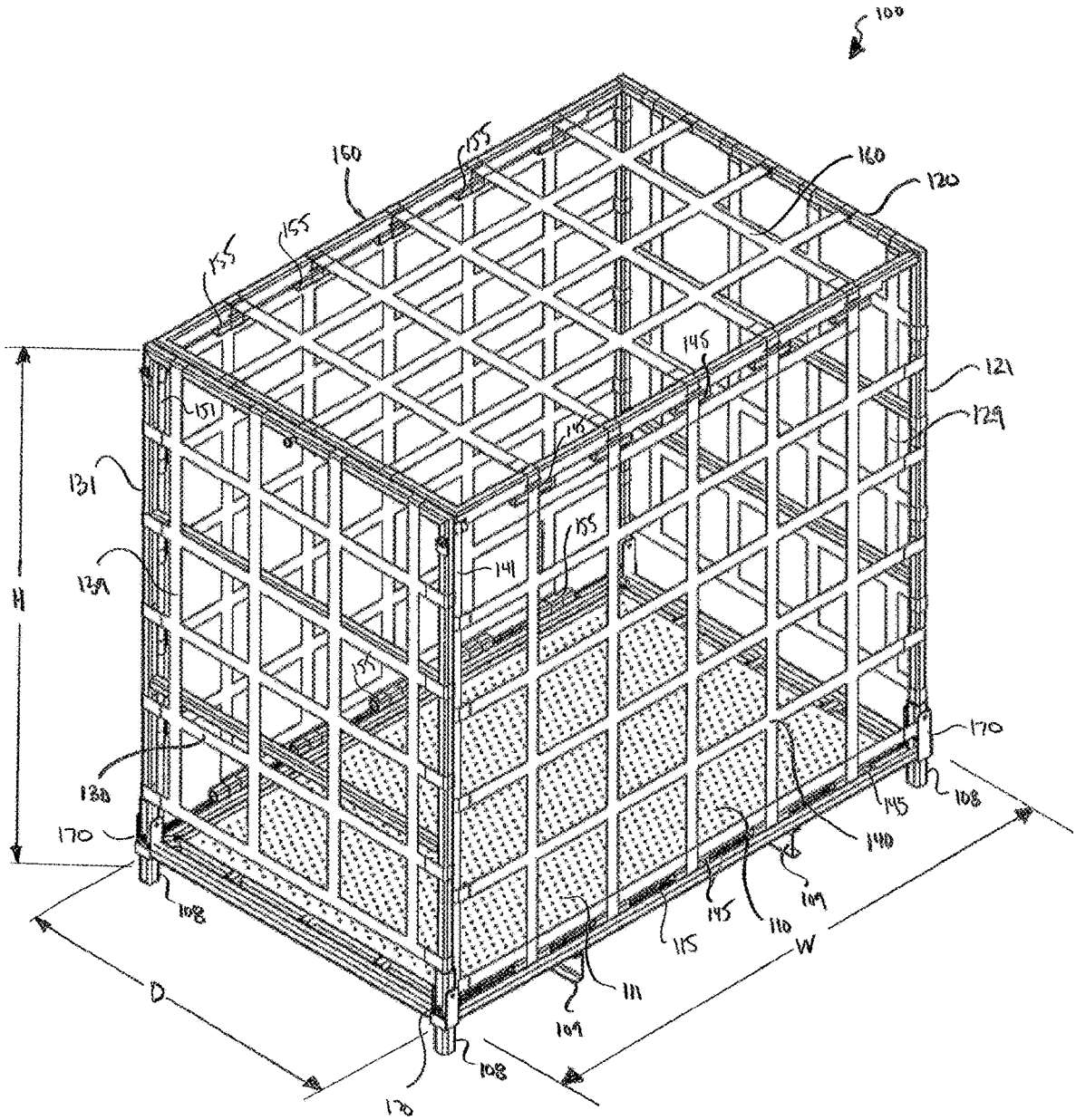
FIG. 1 is an isometric view of an embodiment of a cargo bin in an assembled configuration.

FIG. 1 is an isometric view of one embodiment of a cargo bin 100 shown in an assembled configuration. In some embodiments, the cargo bin 100 is configured to be collapsible into the configuration shown in FIG. 3. The cargo bin 100 is illustrated in a partially assembled configuration in FIG. 2. With reference to the illustrated embodiment of FIGS. 1 and 2, the cargo bin 100 includes a base 110, a right side 120, a left side 130, a front side 140, a back side 150, and a top 160. Positional terms (such as right, left, front, back, and top) are used herein to describe the position of elements relative to the orientation shown in FIG. 1. Positional terms are used for clarity, and are not intended to be limiting. For example, the front side 140 may not be positioned on the front of the cargo bin 100 in all embodiments. Further, features described on the left side can be reversed and incorporated on the right side and vice versa. Similarly, features described on the front side can be reversed and incorporated on the back side and vice versa. In the illustrated embodiment, the base 110, the right side 120, the left side 130, the front side 140, the back side 150, and the top 160 are generally arranged to form a rectangular prism. In some embodiments, the base 110, the right side 120, the left side 130, the front side 140, the back side 150, and the top 160 are positioned at substantially right angles with respect to adjoining sides.

In the assembled configuration, as illustrated in FIG. 1, the cargo bin 100 can have a width W, a depth D, and a height H as shown. In some embodiments, the width W is between 40 inches and 120 inches, between 60 inches and 100 inches, between 70 inches and 90 inches, between 75 inches and 95 inches, or approximately 80 inches, although other widths (larger and smaller) are possible. In some embodiments, the width W is at least 40 inches, at least 60 inches, at least 80 inches, at least 100 inches, at least 120 inches, or more. In some embodiments, the with W is no more than 40 inches, no more than 60 inches, no more than 80 inches, no more than 100 inches, or no more than 120 inches. In some embodiments, the width W is about twice the width of a conventional pallet, such as, for example a GMA pallet. In some embodiments, the width W is about the width of a conventional pallet. In some embodiments, the width W is configured to extend substantially across, or slightly less than, the width of a transport vehicle. For example, in some embodiments, the width W is 95%, 90%, 85%, 80%, or 75% the width of a transport vehicle. In some embodiments, the transport vehicle is a trailer of a semi-truck, a delivery truck, a shipping container, or a railcar, although use with other transport vehicles is possible, without limit. In some cases, the width of a standard transport vehicle is about 8 feet.

In some embodiments, the depth D is between 25 inches and 75 inches, between 35 inches and 65 inches, between 45 inches and 55 inches, or 50 inches, although other depths (larger and smaller) are possible. In some embodiments, the depth D is about the width of a conventional pallet. In some embodiments, the height H is between 40 inches and 120 inches, between 60 inches and 100 inches, between 70 inches and 90 inches, between 75 inches and 85 inches, or 80 inches, although other heights (larger and smaller) are possible. In some embodiments, the depth D is at least 25 inches, at least 35 inches, at least 45 inches, at least 55 inches, at least 65 inches, at least 75 or more. In some embodiments, the with W is no more than 75 inches, no more than 65 inches, no more than 55 inches, no more than 45 inches, no more than 35, or no more than 25 inches. The widths W, depths D, and/or heights H described above can represent the overall external dimensions of the cargo bin 100 or internal dimensions of an interior space enclosed by the base 110, the right side 120, the left side 130, the front side 140, the back side 150, and the top 160.

In the illustrated embodiment, the base 110 can be substantially rectangular, having a width W and a depth D as described above. The base 110 includes an upper surface 111. The upper surface 111 can be substantially flat. In some embodiments, the cargo to be carried by the cargo bin 100 is placed on the upper surface 111 and supported by the base 110. In some embodiments the base 110 is configured to support at least 500 pounds, at least 1,000 pounds, at least 2,500 pounds, at least 5,000 pounds, at least 10,000 pounds, at least 12,000 pounds, at least 14,000 pounds, at least 15,000 pounds or more. In some embodiments, the base 110 is configured to support between 2,500 and 15,000 pounds, between 7,500 and 15,000 pounds, or between 10,000 and 15,000 pounds. In some commercial trucking applications, the base 110 is configured to support at least about the load of two conventional pallets (typically about 7,000 pounds) total. The base 110 can be configured according to intended use. For example, a stronger base 110 can be used in heavier applications, and a lighter base 110 can be used where use with lighter loads is intended. In some embodiments, the base 110 can be a reinforced platform. For example, one or more reinforcing members or structural supports can be positioned below the upper surface 111 to reinforce and strengthen the base 110.

An underside of the base 110 can include tracks 109 configured to be engaged by forks of a forklift. Thus, in some embodiments, the cargo bin 100 is configured to be moved by forklift. In some embodiments, the tracks 109 extend across the depth of the cargo bin 100, such that a forklift can engage with the cargo bin 100 from the front and/or back sides. In some embodiments, the tracks 109 extend across the width of the cargo bin 100, such that a forklift can engage with the cargo bin 100 from the right and/or left sides. In some embodiments, the tracks 109 are configured such that a forklift can engage with the cargo bin from any side (front, back, right, or left). In some embodiments, the cargo bin 100 rests on the tracks 109 when the cargo bin is placed on the ground (or other surface). Thus, the tracks 109 can be configured to support (or partially support) the weight of the cargo bin 100 and any cargo placed therein. In the illustrated embodiment, the cargo bin 100 includes two tracks 109, each comprising a C-shaped channel extending from a lower surface of the base 110. Other types and configurations for the tracks 109, as well as other numbers of tracks 109 (for example a single track or more than two tracks) can be used in some embodiments. The tracks 109 can be configured as any structure for engaging the forks of a forklift. In some embodiments, the tracks 109 can be omitted.

In the illustrated embodiment, the base 110 also includes feet 108. The feet 108 can be configured to support (or partially support) the weight of the cargo bin 100 and any cargo placed therein. In some embodiments, the feet 108 and the tracks 109 together support the weight of the cargo bin 100 and any cargo placed therein. In the illustrated embodiment, the base 110 includes four feet 108, each extending from a corner of the bottom surface of the base 110, although other positionings and numbers of feet 108 are possible. In some embodiments, the feet 108 (and/or the tracks 109) are configured to support the upper surface 111 of the base 110 about 4 inches above the ground or other surface upon which the cargo bin 100 is resting, although other dimensions are possible.

In some embodiments, the upper surface 111 of the base 110 is perforated with small holes. The small holes may be included to allow for drainage in some applications. In some embodiments, the upper surface 111 of the base 110 includes a texture that increases the upper surface's coefficient of friction, for example, to prevent cargo placed thereon from sliding along the surface 111. In some embodiments, the upper surface 111 of the base 110 is substantially smooth.

Figure 2:
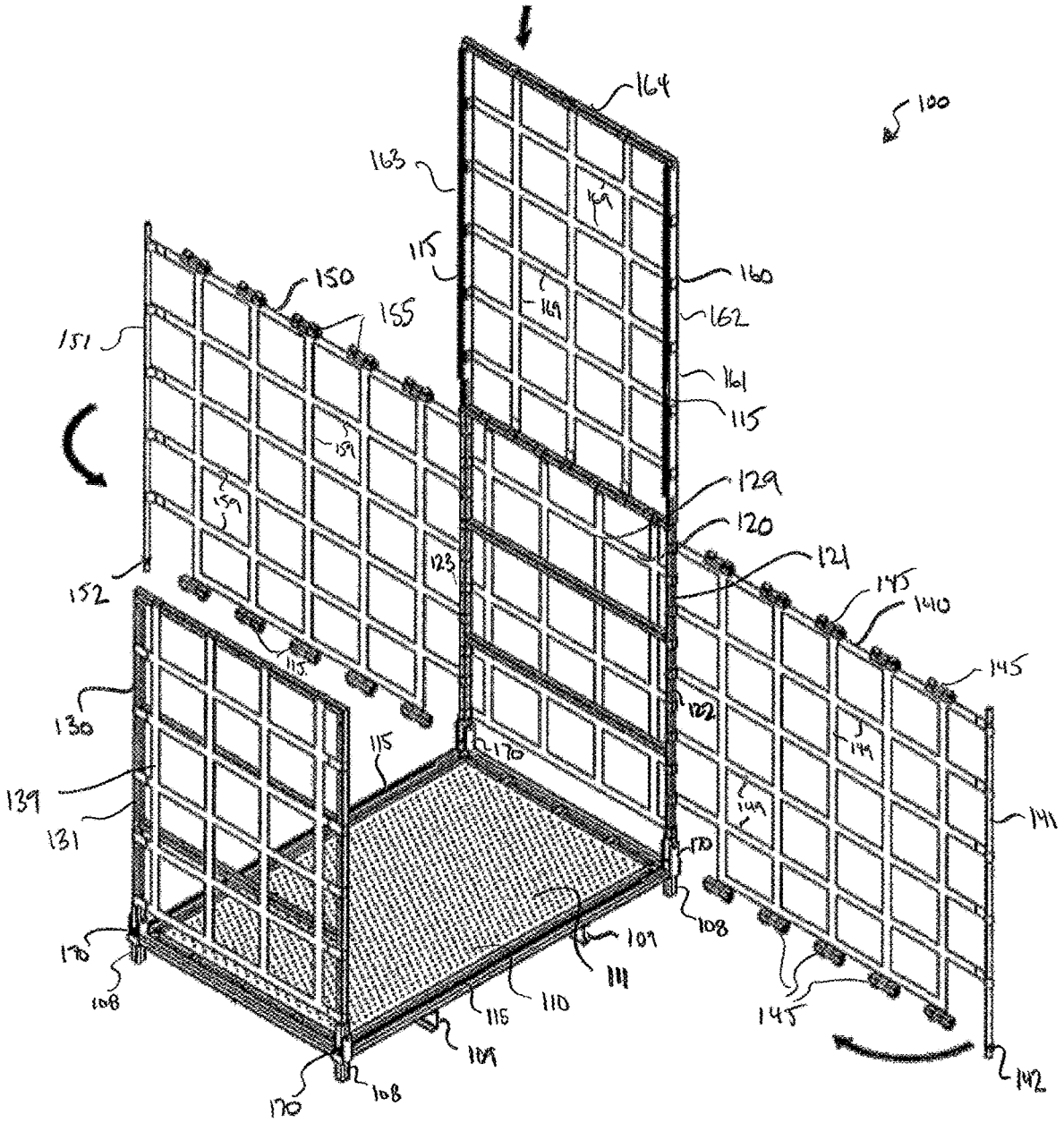
FIG. 2 is an isometric view of the cargo bin of FIG. 1 in a partially assembled configuration.
Figure 6:
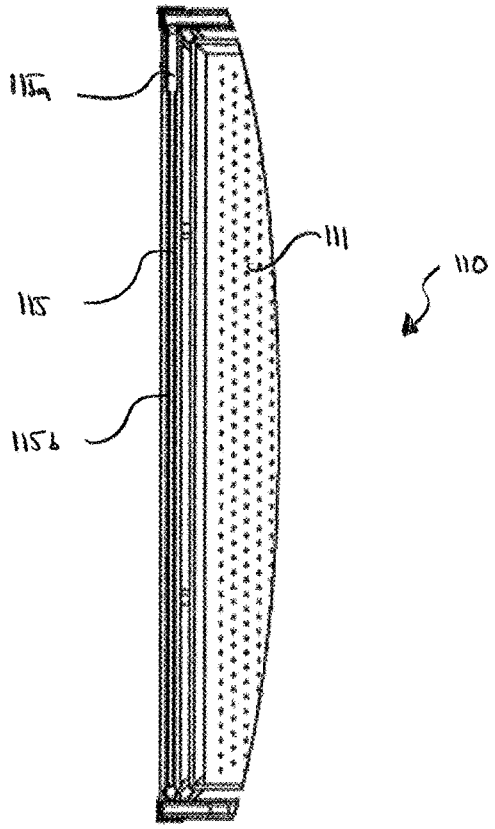
FIG. 6 is a partial top view of the base of the cargo bin of FIG. 1, illustrating a slot formed therein.
Figure 8:
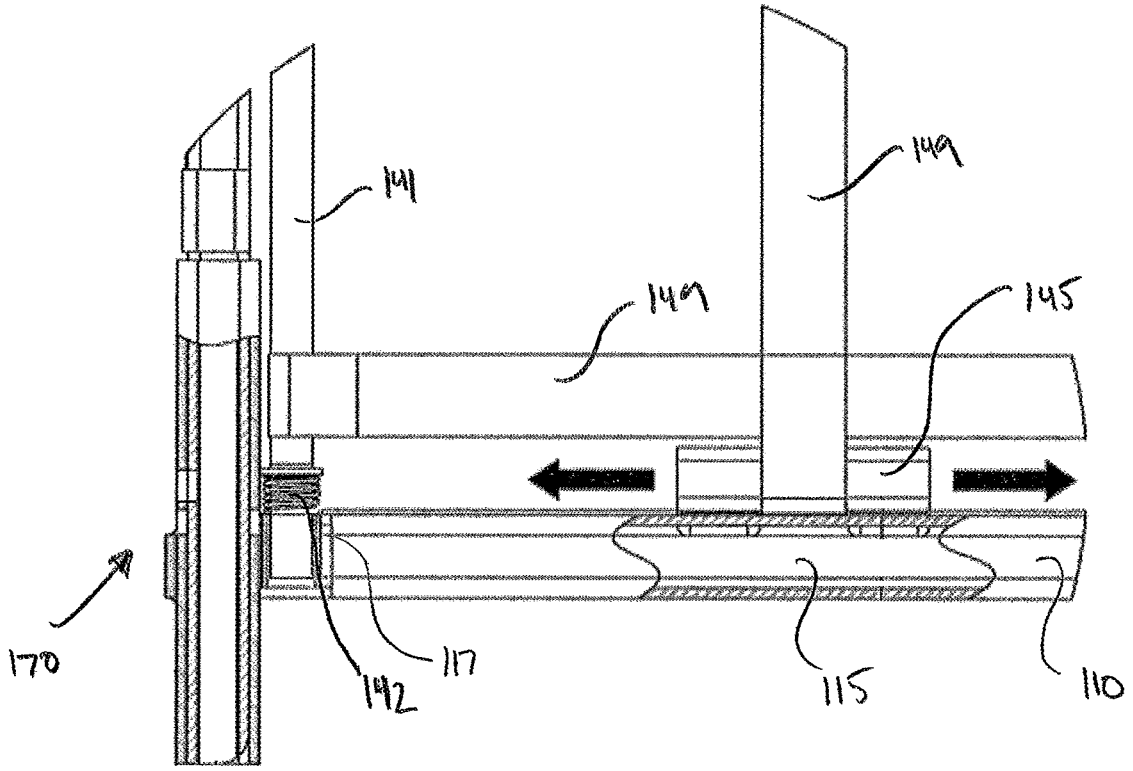
FIG. 8 is a front, partially cutaway, detail view of the cargo bin of FIG. 1, illustrating a guide and the support.

As visible in FIGS. 1 and 2, and shown in greater detail in FIGS. 6 and 8, the base 110 includes slots 115 extending along the front and back edges of the upper surface 111. As will be described in greater detail below, the slots 115 are configured to secure the front side 140 and the back side 150 in the assembled configuration.

Figure 4:
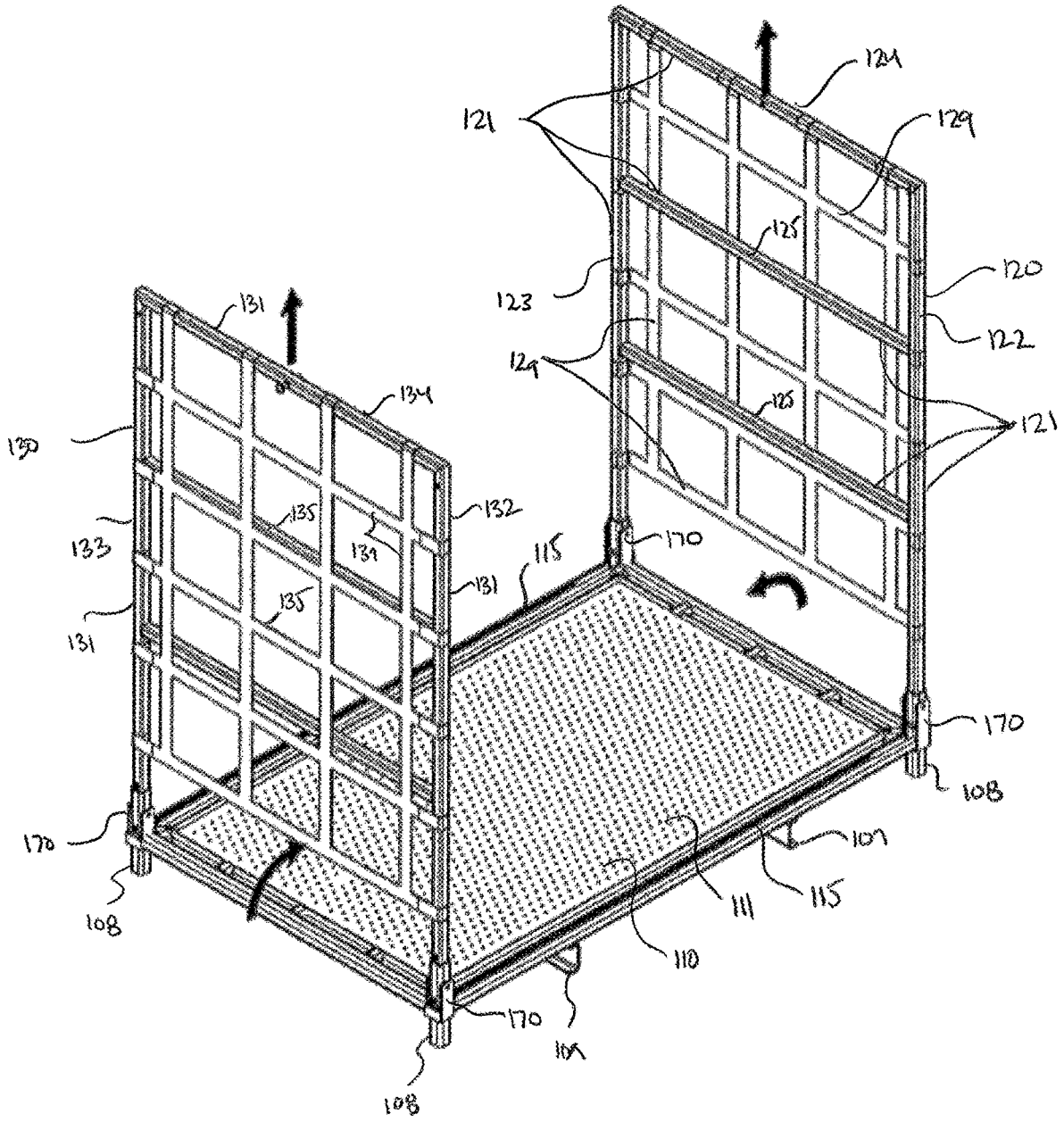
FIG. 4 is an isometric view of a base, a right side, and a left side of the cargo bin of FIG. 1.

In the illustrated embodiment, the left side 130 extends upwardly from the left edge of the base 110 at approximately a right angle. Similarly, the right side 120 extends upwardly from the right edge of the base 110 at approximately a right angle. FIG. 4 illustrates the base 110, the right side 120, and the left side 130 alone (in other words, without the front side 140, the back side 150, and the top 160).

With reference to FIG. 4, in the illustrated embodiment, the right side 120 is substantially rectangular, having depth and height dimensions similar to the depth D and height H dimensions discussed above. The right side 120 comprises a frame 121 and webbing 129. The frame 121 can be substantially rigid. In the illustrated embodiment, the frame 121 comprises a front frame piece 122 (such as a strut), a back frame piece 123 (such as a strut), and a top frame piece 124 (such as a strut). The front frame piece 122 is connected on a lower end to the front right corner of the base 110. In some embodiments, the lower end of the front frame piece 122 is connected to the base 110 by a hinge 170. The hinge 170 will be described below in greater detail with reference to FIGS. 5A and 5B. In some embodiments, the hinge 170 is omitted, and the end the lower end of the front frame piece 122 is rigidly connected to the base 110. An upper end of the front frame piece 122 is connected to a front end of the top frame piece 124. The back frame piece 123 is connected on a lower end to the back right corner of the base 110. In some embodiments, the lower end of the back frame piece 123 is connected to the base 110 by a hinge 170. Again, in some embodiments, the hinge 170 is omitted, and the end the lower end of the front frame piece 122 is rigidly connected to the base 110. An upper end of the back frame piece 123 is connected to a back end of the top frame piece 124. Accordingly, in some embodiments, the front frame piece 122, the back frame piece 123, and the top frame piece 124 form an inverted U-shape attached at the open end to the base 110.

The frame 121 can include one or more additional frame pieces 125 (such as struts). In the illustrated embodiment, two additional frame pieces 125 extend between the front frame piece 122 and the back frame piece 123, substantially parallel to the top frame piece 124. However, this arrangement is merely provided for example, and other arrangements of additional frame pieces 125 are possible. In some embodiments, the additional frame pieces 125 strengthen and increase the rigidity of the frame 121. In some embodiments, the additional frame pieces 125 can be omitted.

The pieces of the frame 121 can have substantially a square, circular, or any other shaped cross-section. In some embodiments, the pieces of the frame 121 are substantially hollow (for example, tubular). In some embodiments, the pieces of the frame 121 are solid. In some embodiments, the front frame piece 122, the back frame piece 123, the top frame piece 124, and the one or more additional frame pieces 125 are welded together, although other joining methods (such as mechanical fasteners, for example) are also possible.

In the illustrated embodiment, the spanning material 129 is attached to the frame 121. In some embodiments, the spanning material 129 is flexible. In some embodiments, the spanning material 129 comprises nylon netting, although other types of materials can be used. In some embodiments, the spanning material 129 comprises webbing, a wire mesh, such as a screen or chain-link. In some embodiments, the spanning material 129 includes openings. In some embodiments, the openings are sufficiently sized such that cargo cannot be easily removed through the openings. In some embodiments, the openings are no more than 0.5 inches, 1 inch, 2 inches, 3 inches, 4 inches, 5 inches, or 6 inches. In some embodiments, the spanning material 129 does not include openings. For example, the spanning material 129 can comprise a flexible sheet of plastic, fabric of other material. In some embodiments, the spanning material 129 can be rigid. For example, the spanning material 129 can comprise a sheet of substantially rigid plastic, wood, or metal.

In the illustrated embodiment, the spanning material 129 is attached to the front frame piece 122, the back frame piece 123, and the top frame piece 124 of the frame 121 by loops which extend around (or through) the front frame piece 122, the back frame pieces 123, and the top frame piece 124. In some embodiments, the spanning material 129 can also be attached to the one or more additional frame pieces 125.

In some embodiments, the spanning material 129 is permanently attached the frame 121. For example, the spanning material 129 can be attached to the frame 121 by stitched loops (in other words, permanently sewn around (or through) the frame 121). In some embodiments, the spanning material 129 is attached to the frame 121 by mechanical fasteners, for example, screws extending through the spanning material 129 and into the frame 121. In some embodiments, the spanning material 129 is adhesively attached to the frame 121. In some embodiments, the spanning material 129 is removably attached to the frame 121. For example, the spanning material 129 can be attached to the frame 121 by hook and loop fasteners, ties, or other suitable mechanisms.

The left side 130 of the cargo bin 100 can be substantially similar to the right side 120. Similarly numbered components of the left side 130 can be substantially similar to those of the right side 120. For example, the left side 130 includes a frame 131 and spanning material 139 similar to the frame 121 and spanning material 129 of the right side 120 described above. For the sake of brevity, description of the components of the left side 130 will not be repeated here.

Figure 3:
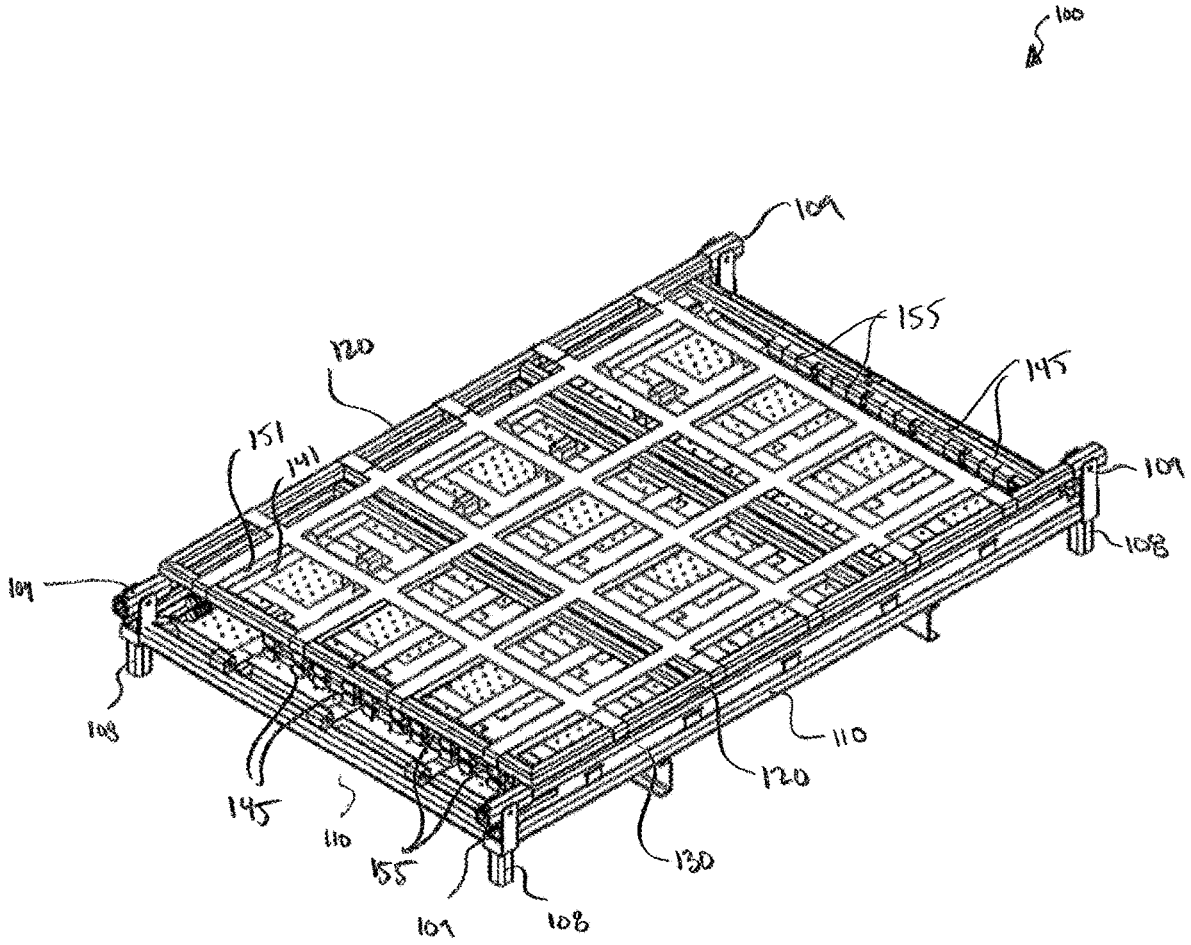
FIG. 3 is an isometric view of the cargo bin of FIG. 1 in a collapsed configuration.

As mentioned above, in some embodiments, the frame 121 of the left side 120 is attached to the base 110 by hinges 170. Similarly, in some embodiments, the frame 131 of the right side 130 is attached to the base 110 by hinges 170. In some embodiments, the hinges 170 allow the left side 120 and the right side 130 to be collapsed on top of the base 110 to transition the cargo bin 100 into a collapsed configuration. With reference to FIG. 3, in some embodiments, in the collapsed configuration the left side 120 and the right side 130 are folded on top of the base 110, although the reverse is also possible. This can substantially reduce the transport or storage space requirement for the cargo bin 100 when empty.

Figure 5A:
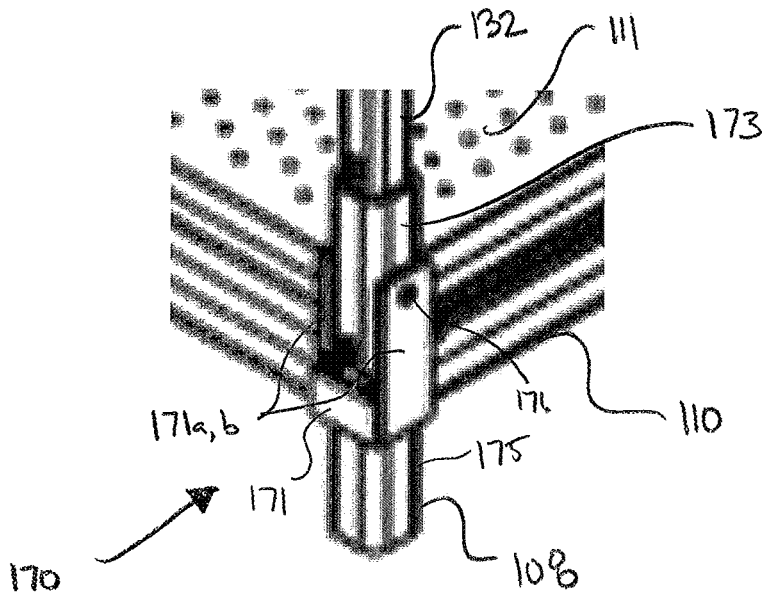
FIG. 5A is an isometric detail view of an embodiment of a hinge of the cargo bin of FIG. 1.
Figure 5B:
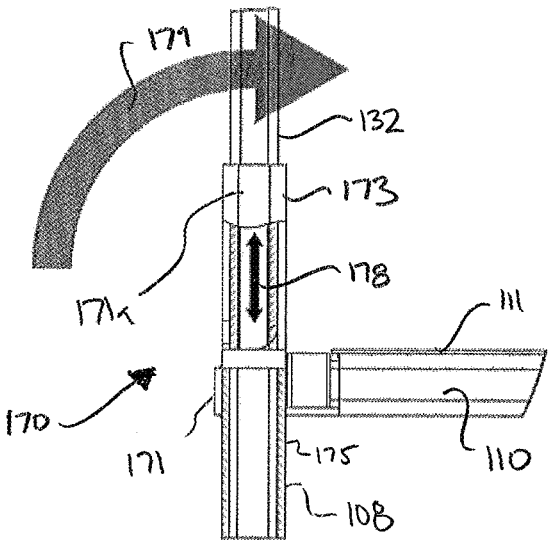
FIG. 5B is a front, partially cutaway, detail view of the hinge of FIG. 5A.

FIGS. 5A and 5B illustrate an embodiment of the hinge 170 in detail. For ease of description, FIGS. 5A and 5B will be described as showing the front left hinge 170, although the description is application to any of the hinges 170 in the cargo bin 100.

FIG. 5A is an isometric detail view and FIG. 5B is a front, partially cutaway, detail view of the hinge 170. In the illustrated embodiment, the hinge 170 includes a rotating tube 173 and a locking tube 175. The locking tube 175 is rigidly attached to the base 110. In some embodiments, the locking tube 175 comprises the foot 108 described above. The locking tube 175 is hollow (for example, tubular) and open on at least an upper end. In some embodiments, the longitudinal axis of the locking tube 175 is approximately normal to the plane of the upper surface 111 of the base 110.

The rotating tube 173 is also hollow (for example, tubular) and is open on both ends. The rotating tube 173 is supported above the locking tube 175 by a support 171. In the illustrated embodiment, the support 171 comprises first and second flanges 171*a*, 171*b*, spaced on opposite sides of the rotating tube 173. The rotating tube 173 is supported between the first and second flanges 171*a*, 171*b* such that it can rotate between a first position, where the longitudinal axis of the rotating tube 173 is aligned with the longitudinal axis of the locking tube 175, and a second position where the longitudinal axis of the rotating tube 173 is not aligned with the longitudinal axis of the locking tube 175. In some embodiments, in the second position, the longitudinal axis of the rotating tube 173 is approximately orthogonal to the longitudinal axis of the locking tube 175. An example of the hinge 170 shown in the first position is illustrated in the assembled configuration of FIG. 1. An example of the hinge 170 shown in the second position is illustrated in the collapsed configuration of FIG. 3.

In some embodiments, the lower end of the front frame piece 132 (such as a strut) is slidingly received within the rotating tube 173, and, in the assembled state, the lower end of the front frame piece 132 is also slidingly received within the locking tube 175. For example, in the assembled state, the rotating tube 173 is aligned with the locking tube 175 (as shown in FIGS. 5A and 5B) and the front frame piece 132 is inserted through the rotating tube 173 and into at least a portion of the locking tube 175. Because the front frame piece 132 is at least partially inserted into the locking tube 175, the front frame piece 132 is held in an upright (assembled) configuration. To transition to the collapsed configuration, the front frame piece 132 is lifted upward (in the direction of the arrows 178 in FIG. 5B) until the end of the front frame piece 132 clears the locking tube 175, the front frame piece 132 and the rotating tube 173 can then be rotated in the direction of arrow 179.

In some embodiments, the hinge 170 includes one or more stops that limit the sliding engagement of the front frame piece 132 with the rotating tube 173 and the locking tube 175. For example, a lower stop can limit how far into the locking tube 175 the front frame piece 132 can be inserted. Similarly, an upper stop can prevent the front frame piece 132 from being fully withdrawn from the rotating tube 173. In some embodiments, the stops can be omitted.

In some embodiments, the hinge point of the rotating tube 173 for the hinges 170 on the right side of the cargo bin 100 is positioned higher than the hinge point of the rotating tubes 173 of the hinges 170 on the left side of the cargo bin 100. In some embodiments, this is achieved by increasing the length of the first and second flanges 171*a*, 171*b* on the hinges 170 on the right side of the cargo bin 100. In some embodiments, this allows the right side 120 to be folded on top of the left side 130 in the collapsed configuration (see FIG. 3). In some embodiments, the reverse is true. For example, the hinge point of the rotating tube 173 for the hinges 170 on the right side of the cargo bin 100 is positioned lower than the hinge point of the rotating tubes 173 of the hinges 170 on the left side of the cargo bin 100. In some embodiments, this is achieved by decreasing the length of the first and second flanges 171*a*, 171*b* on the hinges 170 on the right side of the cargo bin 100. In some embodiments, this allows the right side 120 to be folded under the left side 130 in the collapsed configuration. In some embodiments, the hinge point of the hinges 170 on one side of the cargo bin 100 are positioned higher than the hinge points of the hinges 170 on the opposite side of the cargo bin by a distance that is approximately equal to the thickness of the right or left sides 120, 130. In some embodiments, the space between the hinge points accounts for space required to store the front side 140, back side 150, and the top 160. In some embodiments, in the collapsed configuration (FIG. 3), the base 110, the right side 120, and the left side 130 can be substantially parallel to each other.

Other types of hinges are also useable with the cargo bin 100 described herein. As noted previously, in some embodiments, the hinges can be omitted and the right and left sides 120, 130 can be rigidly attached to the base 100 in an upright configuration.

With reference to FIGS. 1 and 2, the top 160, front side 140, and back side 150 will now be described. In the illustrated embodiment, the top 160 is substantially rectangular having a width and depth dimension similar to the width W and depth D dimensions discussed above. The top 160 can be permanently or removably attached to the right side 120 or the left side 130. The top 160 also includes a frame 161 and spanning material 169. The frame 161 includes a front frame piece 162 (such as a strut), a back frame piece 163 (such as a strut), and a left frame piece 164 (such as a strut). Although not shown, the frame 161 can also include one or more additional frame pieces similar to the additional frame pieces 125 discussed above. In some embodiments, the front frame piece 162, the back frame piece 163, and the left frame piece 164 can be arranged in a U-shape. In some embodiments, the front frame piece 162 and the back frame piece 163 each include a slot 115 on a lower surface thereof. The slot 115 is similar to the slot 115 of the base 110 described below with reference to FIGS. 6 and 8. As will be discussed below, the slot 115 is configured to secure the front and back sides 140, 150 in the assembled configuration of the cargo bin 100.

In some embodiments, the spanning material 169 comprises a flexible material. In some embodiments, the spanning material 169 comprises a nylon net, although other types of materials can be used. In some embodiments, the spanning material 169 comprises webbing, a wire mesh, such as a screen or chain-link. In some embodiments, the spanning material 169 includes openings. In some embodiments, the openings in the spanning material 169 are sufficiently sized such that cargo cannot be easily removed through the openings. In some embodiments, the spanning material 169 does not include openings. For example, the spanning material 169 can comprise a flexible sheet of plastic, fabric, or other material. In some embodiments, the spanning material 169 can be rigid. For example, the spanning material 169 can comprise a sheet of plastic, wood, or metal. The spanning material 169 can be permanently or removably attached to the frame 161 as described above.

In some embodiments of the cargo bin 100, the top 160 is removable or omitted entirely, and the cargo bin 100 remains open on its top side.

In the illustrated embodiment, the front side 140 is substantially rectangular having a width and a height similar to the width W and height H described above. The front side 140 comprises a spanning material 149 and the support 141. In some embodiments, the spanning material 149 comprises a flexible material. In some embodiments, the spanning material 149 comprises a nylon net, although other types of materials can be used. In some embodiments, the spanning material 149 comprises webbing, a wire mesh, such as a screen or chain-link. In some embodiments, the spanning material 149 includes openings. In some embodiments, the openings in the spanning material 149 are sufficiently sized such that cargo cannot be easily removed through the openings. In some embodiments, the spanning material 149 does not include openings. For example, the spanning material 149 can comprise a flexible sheet of plastic, fabric, or other material. In some embodiments, the spanning material 149 can be rigid. For example, the spanning material 149 can comprise a sheet of plastic, wood, or metal.

The spanning material 149 is attached on its right side to the front frame piece 122. In some embodiments, the spanning material 149 is permanently attached to the front frame piece 122, for example, by stitched loops, mechanical fasteners, or adhesive. In some embodiments, the spanning material 149 is removably attached to the front frame piece 122, for example, by hook and loop fasteners. The attachment between the spanning material 149 and the front frame piece 122 allows the front side 140 to pivot around the front frame piece 122 between an open position (FIG. 2) and the assembled position or configuration (FIG. 1).

Along top and bottom edges of the spanning material 149, the front side 140 includes one or more guides 145. In the illustrated embodiment, the front side 140 includes five guides 145 positioned along the top edge of the spanning material 149 and five guides 145 positioned along the bottom edge of the spanning material 149. However, this is merely one example, and other numbers of guides 145 are possible. In some embodiments, the spacing between guides 145 is even. In some embodiments, the guides are positioned approximately 6 inches, 8 inches, 10 inches, 12 inches, 14 inches, 16 inches, or 18 inches apart, although other distances (larger and smaller, as well as ranges in between) are also possible. In some embodiments, the spacing between guides 145 is uneven. The guides 145 interact with the slots 115 in the base 110 and the top 160 to secure the spanning material 149 of the front side 140 to the base 110 and the top 160.

In some embodiments, each guide 145 comprises a T-shaped profile. The narrow end of the T-shaped profile (in other words, the bottom of the T) is attached to the spanning material 149. FIG. 6 illustrates a top view of a portion of the base 110 including the slot 115. As shown in FIG. 6, the slot 115 includes a wide portion 115*a* located at one end of the slot 115 and a narrow portion 115*b*. The wide end of the T-shaped profile (in other words, the top of the T) of each guide 145 is configured to be inserted into the slot 115 through the wide portion 115*a*. The guide 145 can then slide along the slot 115 into the narrow portion 115*b*. When positioned in the narrow portion 115*b* of the slot 115, the guide 145 cannot be pulled free from the slot 115 because the wide portion of the T-shaped profile cannot be removed through the narrow portion 115*b* of the slot 115. Thus, the spanning material 149 can be secured to both the base 110 and the top 160 by positioning each guide 145 within the wide portion 115*a* and then sliding it into the narrow portion 115*b* of the slot 115. The only way to remove the guides 145 from the narrow portion 115*b* is to slide the guides back to the wide portion 115*a*. FIG. 8 is a partially cutaway detail view illustrating a T-shaped guide 145 positioned within the slot 115 in the base 110. The guide 145 can slide back and forth in the direction of the arrows, but can only be removed from the slot 115 when positioned in the wide portion 115*a*.

Figure 7:
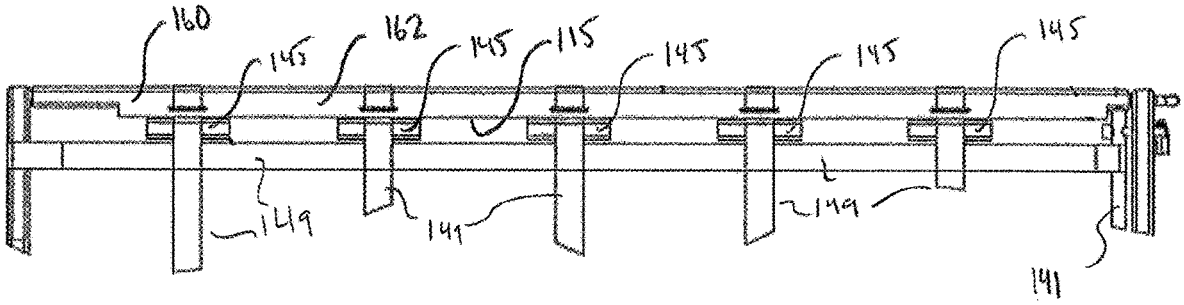
FIG. 7 is a partial front view of the cargo bin of FIG. 1, illustrating a plurality of guides securing a spanning material of the front side to the top.

FIG. 7 shows a front detail view of five guides 145 securing spanning material 149 of the front side 145 to the top 160. The guides 145 are positioned within the slot 115 on the underside of the front frame piece 162 of the top 160.

In some embodiments, the guides 145 can comprise other shapes beyond having a T-shaped profile. In some embodiments of the cargo bin 100 that do not include the top 160, the guides 145 along the top edge of the spanning material 149 can be omitted.

With reference again to FIGS. 1 and 2, the spanning material 149 is attached on its left side to the support 141. In the illustrated embodiment, the support 141 is a cylindrical pole having a height that is approximately equal to the height H discussed above. In some embodiments, other cross-sectional shapes for the support 141 are possible. In some embodiments, a bottom end of the support 141 includes a spring element 142. In some embodiments, the spring element 142 is coil spring. In some embodiments, the spring element 142 is positioned on a top end of the support 141. In some embodiments, the spring element 142 is omitted. In some embodiments, the spanning material 149 is permanently attached to the support 141, for example, by stitched loops, mechanical fasteners, or adhesive. In some embodiments, the spanning material 149 is removably attached to the support 141, for example, by hook and loop fasteners.

Figure 9A:
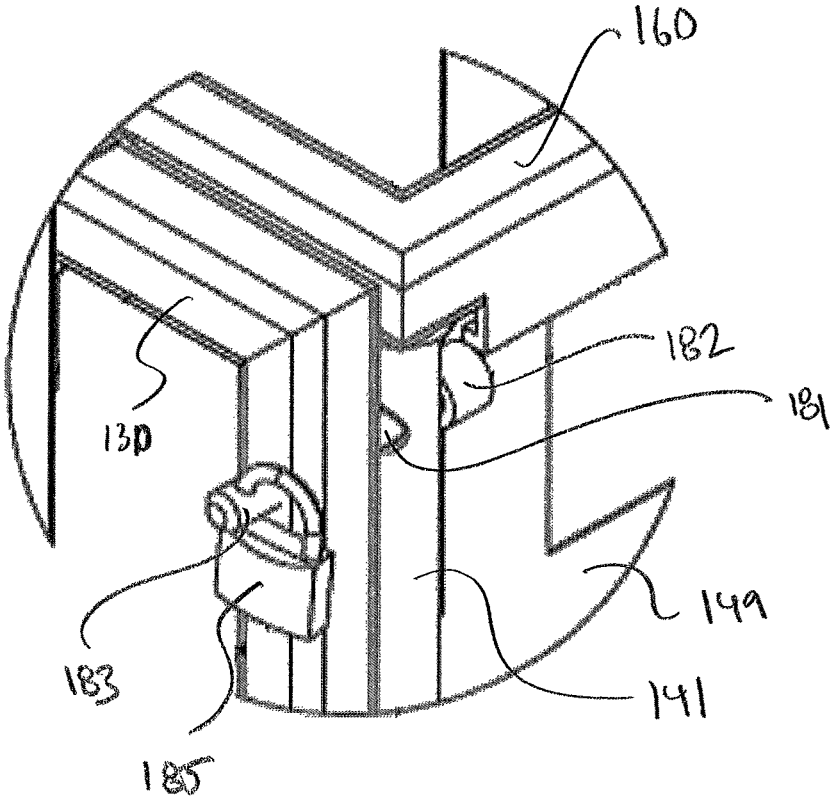
FIG. 9A is an isometric detail view illustrating a pin for securing the support to the left side in the cargo bin of FIG. 1.
Figure 9B:
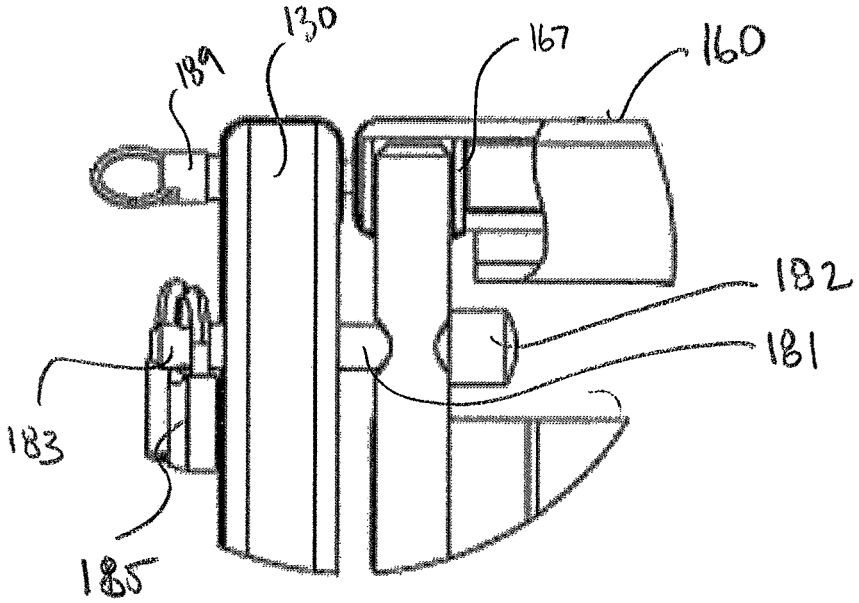
FIG. 9B is a side detail view illustrating the pin and support of FIG. 9A.

In some embodiments, the support 141 is used to secure the left end of the front side 140 in the assembled configuration (FIG. 1). For example, as shown in FIG. 1, the support 141 is secured between the base 110 and the top 160. A bottom end of the support 141 is received within a hole 117 in the base 110 (FIG. 8) and a top end of the support 141 is received within a hole 167 in the top 160 (FIG. 9B). In some embodiments, the spring element 142 facilitates the placement of the support 141 between the base 110 and the top 160. For example, in some embodiments, the bottom end of the support 141 is positioned within the hole 117 in the base 110. The support 141 is pressed downward, compressing the spring element 142, such that the top end of the support 141 can slide under the top 160. The support 141 is then released, allowing the spring element 142 to expand. As the spring element 142 expands, the support 141 is pushed upwardly into the hole 167 of the top 160.

In some embodiments, when the support 141 is secured in place, the guides 145 are prevented from sliding to the wide end 115*a* of the slot because there is not enough slack in the spanning material 149.

In some embodiments, the support 141 can further be secured to the left side 130 in order to prevent the support 141 from being removed. As shown in FIGS. 9A and 9B, in some embodiments, a pin 181 can be inserted through the frame 131 of the right side 130 and the support 141. The pin 181 can include a fat end that prevents the pin 181 from being pulled all the way through the support 141. The opposite end 183 of the pin 181 can include an opening which can be secured by a locking mechanism 185. The locking mechanism 185 can be a padlock or any other type of suitable locking device. In some embodiments, once locked, the cargo bin 180 is fully secured. Also shown in FIG. 9B, in some embodiments, a detent pin 189 can similarly be used to further secure the top 160 to the right side 130.

The back side 150 can be substantially similar to the front side 140. Similarly numbered components of the back side 150 can be substantially similar to those of the front side 140. For example, the back side 150 includes the support 151 and spanning material 159 similar to the support 141 and spanning material 149 of the front side 140 described above. Further, the back side 150 can be secured using guides 155 and the support 151 in a similar manner as described above with reference to the front side 140. For the sake of brevity, description of the components of the back side 150 will not be repeated here.

As shown in FIG. 3, in the collapsed configuration, the front side 140 and the back side 150 can be positioned between the right side 120 and the left side 130. In some embodiments, the front side 140 and the back side 150 can be positioned below the right side 140 and the left side 150 and above the base 110 in the collapsed configuration. In some embodiments, the front side 140 and the back side 150 can be positioned on top of the right side 120 and the left side 130 in the collapsed configuration. In some embodiments, because the front side 140 and the back side 150 do not include a fully rigid frame and are instead formed by spanning material 149, 159 attached at one end to the support 141, 151, the front side 140 and back side 150 can be folded, rolled, or loosely positioned in any of the positions discussed above in the collapsed configuration.

In some embodiments, in the collapsed configuration, a plurality of cargo bins 100 are configured to be stacked on top of each other. For example, the feet 108 of one cargo bin 100 can rest on top of the hinges 170 of another cargo bin 100.

An example process for transitioning the cargo bin 100 from the collapsed configuration (FIG. 3) to the assembled configuration (FIG. 1) will now be described. The following description is provided by way of example only, and, in some embodiments the steps can be rearranged, modified, or omitted. Further, a process for transitioning the cargo bin 100 from the assembled configured (FIG. 1) to the collapsed configuration (FIG. 3) can involve performing these steps in the reverse order.

In some embodiments, beginning with the cargo bin 100 in the collapsed configuration (FIG. 3), the right side 120 (with attached front and back sides 140, 150, and top 160) can be pivoted into a vertical position. The front frame piece 122 and the back frame piece 123 of the right side 120 are lowered into the locking tubes 175 of the right side hinges 170 (see FIGS. 5A and 5B). The locking tubes 175 hold the right side 120 in a vertical position. In some embodiments, at this point the front side 140 and the back side 150 are draped loosely over the base 110 and the top 160 hangs down either to the inside or outside of the right side 120. Next, the left side 130 is pivoted into a vertical position. The front frame piece 132 and the back frame piece 133 of the left side 130 are lowered into the locking tubes 175 of the left side hinges 170 (again see FIGS. 5A and 5B). The locking tubes 175 hold the left side 130 in a vertical position. At this point, the base 110, left side 120, and right side 130 are in the configuration shown in FIG. 2.

In some embodiments, the top 160 is then rotated into position. The top 160 can be secured to the left side 130 by aligning a hole in the left frame piece 164 of the top 160 with a hole in the top frame piece 134 of the left side and inserting the detent pin 189 through the holes (see FIG. 9B). In some embodiments, the detent pin 189 holds the top 160 in place for the remaining assembly steps. In some embodiments, the detent pin 189 can be secured with a locking mechanism. At this point the front and back of the cargo bin 100 are still open. In some embodiments, the back side 150 is then closed. Beginning with the top and bottom guides 155 of the back side 150 closest to the support 151, the guides 155 are inserted through the wide portion 115*a* of the slots 115 in the top 160 and the base 110. The guides 155 are then slid into the narrow portion 115*b* of the slot 115. This process is repeated, in order, for each of the guides 155 moving away from the support 151. In some embodiments, during this process, the support 151 hangs freely. Next, the support 151 of the back side 150 is secured. Once all the guides 155 are engaged with the slots 115, the support 151 is located near the left side 130 of the cargo bin 100. The lower end of the support 151 is inserted into hole 117 in the base, compressing the spring element 142 (see FIG. 8). This allows the upper end of the support 151 to be inserted into the hole 167 in the top 160 (see FIG. 9B). The spring force of the spring element 142 will cause the top end of the support 151 to engage with the hole 167 on the underside of the top 160 locking the back side 150 in place.

In some embodiments, at this point, cargo can be loaded into the cargo bin 100. For example, cargo can be placed on the base 110. In some embodiments, cargo is loaded prior to securing the back side 150 and/or prior to securing the top 160. Next, the front side 140 can be secured. Beginning with the top and bottom guides 145 of the front side 140 closest to the support 141, the guides 145 are inserted through the wide portion 115*a* of the slots 115 in the top 160 and the base 110. The guides 145 are then slid into the narrow portion 115 of the slot 115. This process is repeated, in order, for each of the guides 145 moving away from the support 141. In some embodiments, during this process, the support 141 hangs freely. Next, the support 141 of the front side 140 is secured. Once all the guides 145 are engaged with the slots 115, the support 141 is located near the left side 130 of the cargo bin 100. The lower end of the support 141 is inserted into hole 117 in the base, compressing the spring element 142 (see FIG. 8). This allows the upper end of the support 141 to be inserted into the hole 167 in the top 160 (see FIG. 9B). The spring force of the spring element 142 will cause the top end of the support 141 to engage with the hole 167 on the underside of the top 160 locking the front side 140 in place.

In some embodiments, the cargo bin 100 can then be fully secured by locking the supports 141, 151 in place. In some embodiments, locking the supports 141, 151 involves aligning holes in the supports 141, 151 with holes in the left side 130 and inserting pins 181 therethrough (see FIGS. 9A and 9B). The pins 181 can be secured with locking mechanism 183, such as the padlocks illustrated in the figures. The locking mechanism 183 can provide any method for securing the pins, including, padlocks, standard truck seals, electronic locks, deadbolts, etc. Once locked, the supports 141, 151 cannot be removed. This secures the cargo within the cargo bin 100.

In some embodiments, the cargo bins 100 provide one or more advantages. For example, cargo bins 100 allow cargo to be secured at an origin destination and then safely transported to a delivery destination. Because the cargo is secured within the cargo bin 100, tampering or loss of cargo during transport is reduced or prevented. The cargo bin 100 can be unlocked at the delivery destination to remove the cargo. Thus, in some embodiments, the cargo bins 100 provide secure internal chain of custody for cargo during transport.

Additionally, once the cargo bin 100 is unloaded, the cargo bin 100 can be transitioned to the collapsed state. In some embodiments, several collapsed cargo bins 100 can be stacked. In some embodiments, this allows for storage and/or backhaul of empty cargo bins 100 in a reduced space footprint.

In some embodiments, the cargo bins 100 are configured to accommodate a unit load size that is approximately twice that of a conventional pallet. In some embodiments, this allows for quicker loading and unloading of transport vehicles as the number of forklift moves is reduced by half. In some embodiments, the cargo bins 100 are configured to extend substantially across the width of the transport vehicle, such that only a single row of cargo bins 100 is required to fill the transport vehicle. Again, this can simplify loading and unloading of the transport vehicle.

In some embodiments, multiple cargo bins 100 can be aligned back to front. When aligned, and front and back sides 140, 150 of the cargo bins 100 are open, the bases 110 of the cargo bins 100 are configured to form a uniform floor surface. In some embodiments, this can allow the cargo bins 100 to loaded and/or unloaded as if working directly from the floor of the truck. This can prevent injury as workers are able to work from a smooth, flat, or generally consistent work surface, rather than climbing over empty pallets and packing materials.

In some embodiments, the cargo bins 100 are assembled from standard kit materials. This allows for simplified assembly, repair, or replacement of parts. In some embodiments, the cargo bins 100 are configured to be easily repairable.

In some embodiments, the cargo bins 100 are configured to be relatively light weight. For example, in some embodiments, a cargo bin 100 weighs less than 500 pounds, less than 400 pounds, less than 300 pounds, less than 200 pounds, or less than 100 pounds, although other weights are possible. In some embodiments, the cargo bins 100 are configured to be at light as possible, while still being sufficiently strong to support the loads placed therein.

In some embodiments, the cargo bins 100 can be advantageously used in cross-docking applications. For example, a plurality of cargo bins 100 can be loaded at an origin destination. The cargo bins 100 can be loaded into a first transport vehicle. The first transport vehicle can deliver the cargo bins 100 to a cross-docking location. The cargo bins 100 can be unloaded from the first transport vehicle and loaded into one or more additional transport vehicles for delivery to final destinations. Advantageously, the number of forklift moves can be reduced due the size of the cargo bins 100. Additionally, the cargo can be secured during each step in the process because the cargo bins 100 are securable. Further, once unloaded at the delivery destinations, the cargo bins 100 can either be reloaded or collapsed and/or stacked for backhaul or storage.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being re-defined herein to be restricted to including any specific characteristics of the features or aspects of the technology with which that terminology is associated.

It will be appreciated by those skilled in the art that various modifications and changes can be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the figures can be combined, interchanged or excluded from other embodiments.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims. Applicant reserves the right to submit claims directed to combinations and sub-combinations of the disclosed inventions that are believed to be novel and non-obvious. Inventions embodied in other combinations and sub-combinations of features, functions, elements and/or properties can be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

What is claimed is:

1. A cargo bin, comprising:

a base having an upper surface;

a first side pivotally attached to a first edge of the base by a first set of hinges, the first side including a rigid frame and a spanning material;

a second side pivotally attached to a second edge of the base by a second set of hinges, the second edge opposite the first edge, the second side including a rigid frame and a spanning material;

a front side including a flexible spanning material pivotally attached on a first end to the rigid framing of the first side, and a first support attached to a second end of the spanning material, the second end opposite the first end, a first tip of the first support configured to be insertable into a first hole in the base to close the front side, wherein the first hole is formed in the base adjacent to one of the second set of hinges of the second side such that the first support can be inserted into the first hole to close the front side; and a back side including a spanning material attached on a first end to the rigid framing of the first side, and a second support attached to a second end of the spanning material, the second end opposite the first end, a first tip of the second support configured to be insertable into a second hole in the base to close the back side, wherein the second hole is formed in the base adjacent to the other of the second set of hinges of the second side such that the second support can be inserted into the second hole to close the second side, wherein the first and second supports comprise rigid poles.

2. The cargo bin of claim 1, further comprising a top pivotally connected to the first side, the top comprising a rigid frame and a spanning material.

3. The cargo bin of claim 2, wherein a second tip of the first support of the front side is configured to be insertable into a first hole in the rigid frame of the top.

4. The cargo bin of claim 3, wherein a second tip of the second support of the back side is configured to be insertable into a second hole in the rigid frame of the top.

5. The cargo bin of claim 2, wherein the front side further comprises one or more guides positioned along a top edge of the spanning material, and wherein the top comprises a first slot configured to receive the guides.

6. The cargo bin of claim 2, wherein the back side further comprises one or more guides positioned along a top edge of the spanning material, and wherein the top comprises a second slot configured to receive the guides.

7. The cargo bin of claim 1, wherein the first support of the front side includes a spring element on the first tip.

8. The cargo bin of claim 1, wherein the second support of the back side includes a spring element on the first tip.

9. The cargo bin of claim 1, wherein the first support of the front side comprises a hole, wherein the rigid frame of the second side comprises a first hole, and wherein a first pin is insertable through the hole of the first support of the front side and the first hole of the rigid frame of the second side to secure the support of the front side to the second side.

10. The cargo bin of claim 9, further comprising a locking mechanism for locking the first pin.

11. The cargo bin of claim 1, wherein the second support of the back side comprises a hole, wherein the rigid frame of the second side comprises a second hole, and wherein a second pin is insertable through the hole of the second support of the back side and the second hole of the rigid frame of the second side to secure the support of the back side to the second side.

12. The cargo bin of claim 11, further comprising a locking mechanism for locking the second pin.

13. The cargo bin of claim 1, wherein the front side further comprises one or more guides positioned along a bottom edge of the spanning material, and wherein the base comprises a first slot configured to receive the guides.

14. The cargo bin of claim 13, wherein the one or more guides comprise a substantially T-shaped cross-sectional profile.

15. The cargo bin of claim 1, wherein the back side further comprises one or more guides positioned along a bottom edge of the spanning material, and wherein the base comprises a second slot configured to receive the guides.

16. The cargo bin of claim 1, wherein at least one of the first set of hinges comprises:

a locking tube rigidly mounted to the base;

a rotating tube pivotally supported above the locking tube;

wherein, in a first configuration, a longitudinal axis of the locking tube and a longitudinal axis of the rotating tube are aligned, and a portion of the rigid frame of the first side extends through the rotating tube and is at least partially received within the locking tube; and wherein, in a second configuration, the longitudinal axis of the locking tube and the longitudinal axis of the rotating tube are not aligned, and a portion of the rigid frame of the first side extends through the rotating tube, and no portion of the rigid frame of the first side is received within the locking tube.

17. The cargo bin of claim 1, wherein at least one of the second set of hinges comprises:

a locking tube rigidly mounted to the base;

a rotating tube pivotally supported above the locking tube; and wherein, in a first configuration, a longitudinal axis of the locking tube and a longitudinal axis of the rotating tube are aligned, and a portion of the rigid frame of the second side extends through the rotating tube and is at least partially received within the locking tube;

wherein, in a second configuration, the longitudinal axis of the locking tube and the longitudinal axis of the rotating tube are not aligned, and a portion of the rigid frame of the second side extends through the rotating tube, and no portion of the rigid frame of the second side is received within the locking tube.

18. The cargo bin of claim 1, wherein the cargo bin is transitionable between an assembled configuration and a collapsed configuration.

19. The cargo bin of claim 1, wherein the front side is configured to pivot about the first end when the cargo bin is in an assembled configuration.

* * * * *